US012487065B2

(12) United States Patent
Armstrong et al.

(10) Patent No.: US 12,487,065 B2
(45) Date of Patent: Dec. 2, 2025

(54) SIMULATED TELESCOPIC MORTAR BOMB

(71) Applicant: Cubic Corporation, San Diego, CA (US)

(72) Inventors: Martyn Armstrong, Salisbury (GB); Neale Smiles, Salisbury (GB); Alastair Parkinson, Salisbury (GB); John Ivor Gardiner, Amesbury (GB); Paul Moncrieff, Amesbury (GB); Thomas Edward Burroughs, Salisbury (GB)

(73) Assignee: Cubic Corporation, San Diego, CA (US)

( * ) Notice: Subject to any disclaimer, the term of this patent is extended or adjusted under 35 U.S.C. 154(b) by 67 days.

(21) Appl. No.: 18/534,312

(22) Filed: Dec. 8, 2023

(65) Prior Publication Data

US 2024/0328763 A1 Oct. 3, 2024

Related U.S. Application Data

(60) Provisional application No. 63/386,872, filed on Dec. 9, 2022.

(51) Int. Cl.
*F42B 8/20* (2006.01)

(52) U.S. Cl.
CPC ..... *F42B 8/20* (2013.01)

(58) Field of Classification Search
CPC ..... F42B 8/20; F42B 8/00; F42B 8/08; F42B 8/12
USPC ..... 102/445, 444, 498, 502
See application file for complete search history.

(56) References Cited

U.S. PATENT DOCUMENTS

| | | | | |
|---|---|---|---|---|
| 3,134,330 | A | 5/1964 | Batou | |
| 3,386,381 | A * | 6/1968 | Ferb | F42B 12/54 102/512 |
| 5,874,691 | A * | 2/1999 | Manole | F42B 12/34 102/521 |
| 8,640,625 | B1 * | 2/2014 | Wong | F42B 8/14 102/444 |
| 2018/0364006 | A1 * | 12/2018 | Reymann | G01S 19/13 |

FOREIGN PATENT DOCUMENTS

| | | | |
|---|---|---|---|
| DE | 49443 | C | 11/1889 |

* cited by examiner

*Primary Examiner* — John Cooper
(74) *Attorney, Agent, or Firm* — MUGHAL GAUDRY & FRANKLIN PC

(57) ABSTRACT

A training round for performing indirect fire mission, including a top end oriented towards a direction of projectile motion of the training round. A bottom end is situated opposite to the top end. The top end and the bottom end are separated by a first distance. An adjuster is arranged between the top end and the bottom end to adjust a length of the training round. The adjuster compresses such that the top end and the bottom end are separated by a second distance. The second distance is less than the first distance. A round sensor attached to the training round and communicatively couples to a simulation computer while performing the indirect fire training mission.

19 Claims, 10 Drawing Sheets

SIMULATED TELESCOPIC MORTAR BOMB

PRIORITY

This application is a non-provisional of and claims priority to U.S. Provisional Patent Application No. 63/386,872, filed Dec. 9, 2022, the content of which is incorporated herein by reference in its entirety for all purposes.

BACKGROUND

This disclosure generally relates to training rounds for performing indirect fire missions among other things.

Training troops for indirect fire missions include the usage of various simulated munitions, such as artillery, mortar, rockets, grenade launchers, and machine guns. The ammunition is either live ammunition or simulated ammunition. The simulated munitions are coupled with electronic components to achieve comprehensive training in indirect fire missions.

SUMMARY

In one embodiment, a training round for performing indirect fire mission is disclosed. The training round includes a top end oriented towards a direction of projectile motion of the training round. A bottom end is situated opposite to the top end. The top end and the bottom end are separated by a first distance. An adjuster is arranged between the top end and the bottom end to adjust a length of the training round. The adjuster compresses such that the top end and the bottom end are separated by a second distance. The second distance is less than the first distance. A round sensor attached to the training round and communicatively couples to a simulation computer while performing the indirect fire training mission.

In another embodiment, a training round for performing indirect fire missions is disclosed. The training round includes a top end oriented towards a direction of projectile motion of the training round. A bottom end situated opposite to the top end. The top end and the bottom end are separated by a first distance. A telescopic assembly is situated between the top end and the bottom end to induce a telescopic movement between the top end and the bottom end, such that the top end and the bottom end are separated by a second distance. A weight of the top end induces the telescopic movement between the top end and the bottom end. A round sensor is attached to the training round to establish communicative coupling with a simulation computer during an execution of indirect fire missions.

In still embodiment, a training round for performing indirect fire missions is disclosed. The training round includes a projectile shell having a conical top oriented towards a direction of projectile motion of the training round. The projectile shell also an internal chamber having an orifice at a base of the projectile shell. The training round further comprises a stabilizing rod connected to the base of the projectile shell. The projectile shell and the stabilizing rod are separated by a first distance. A hydraulic system is situated between projectile shell and the stabilizing rod to adjust a length of the training round. The hydraulic system has a first tube fixedly connected to the projectile shell, a second tube fixedly connected to stabilizing rod and movably connected to the projectile shell, and a conduit for a transmission of a fluid between the first tube and the second tube. A telescopic movement is induced between the first tube and the second tube when the second tube moves inside the first tube. The projectile shell and the stabilizing rod are separated by a second distance upon induction of the telescopic movement. A round sensor is attached to the training round for establishing communicative coupling with a simulation computer during an execution of the indirect fire missions.

Further areas of applicability of the present disclosure will become apparent from the detailed description provided hereinafter. It should be understood that the detailed description and specific examples, while indicating various embodiments, are intended for purposes of illustration only and are not intended to necessarily limit the scope of the disclosure.

BRIEF DESCRIPTION OF THE DRAWINGS

The present disclosure is described in conjunction with the appended figures.

In the appended figures, similar components and/or features may have the same reference label. Further, various components of the same type may be distinguished by following the reference label by a second alphabetical label that distinguishes among the similar components. If only the first reference label is used in the specification, the description is applicable to any one of the similar components having the same first reference label irrespective of the second reference label.

DETAILED DESCRIPTION

The ensuing description provides preferred exemplary embodiment(s) only, and is not intended to limit the scope, applicability or configuration of the disclosure. Rather, the ensuing description of the preferred exemplary embodiment(s) will provide those skilled in the art with an enabling description for implementing a preferred exemplary embodiment. It is understood that various changes may be made in the function and arrangement of elements without departing from the spirit and scope as set forth in the appended claims.

Embodiments described herein are generally related to training systems and methods for indirect fire missions using mortar rounds equipped with advanced hydraulic or telescopic mechanisms, and communicative coupling with remote computers, aiming to simulate realistic firing conditions, enhance training effectiveness, and improve operational accuracy for military or defense personnel, among other things.

Figure 1:
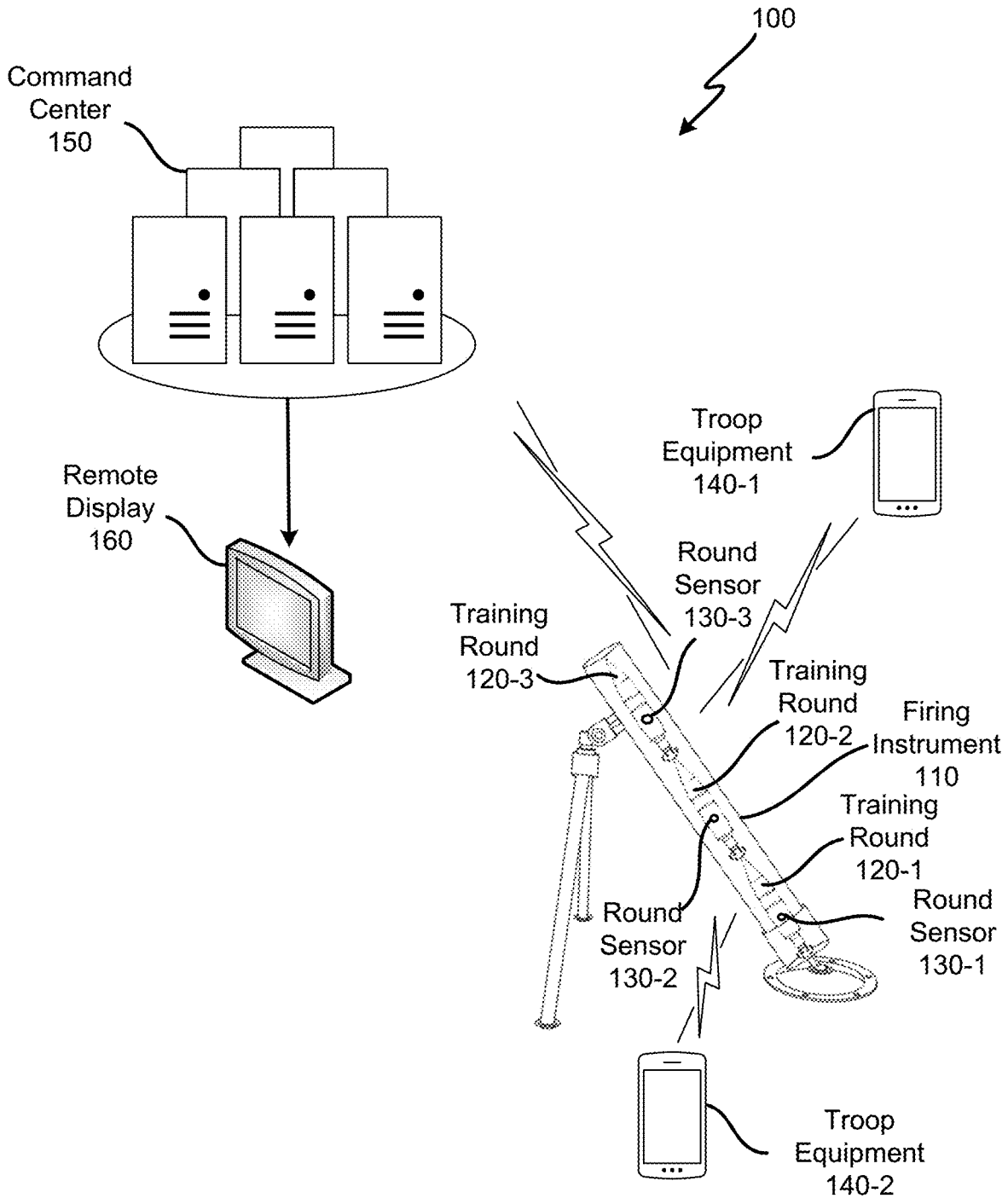
FIG. 1 illustrates a schematic representation of a training site according to an embodiment of the present disclosure.

Referring to FIG. 1 illustrates a training site 100, at which indirect fire missions are performed. The training site 100 includes a firing instrument 110 that is equipped with a barrel, in which three training rounds, 120-1, 120-2, and 120-3, are stacked one over the other, and ready to be fired for the indirect fire missions.

Each of the training rounds 120-1, 120-2, 120-3 within the firing instrument 110 is equipped with a round sensor 130-1, 130-2, 130-3. The round sensors 130-1, 130-2, and 130-3 are attached to the training rounds to gather and transmit various data parameters related to the trajectory, position, orientation, and other relevant readings necessary for indirect fire missions.

The round sensors 130-1, 130-2, and 130-3 wirelessly communicate with troop equipment 140-1, 140-2. For example, the troop equipment 140-1, 140-2 is a handheld display device, held by troops on the training site 100 to receive real-time feedback and information related to the round sensors 130-1, 130-2, 130-3. Troops can view essential data, such as the position, orientation, and other readings associated with each training round, aiding in training effectiveness and tactical decision-making during indirect fire missions.

Additionally, the round sensors 130-1, 130-2, 130-3 establish wireless communication with a command center 150 equipped with a remote display 160. The remote display 160 at the command center 150 receives data transmitted by the round sensors 130-1, 130-2, 130-3. The data is further displayed on the remote display 160. The command center 150 acts as a centralized monitoring and coordination hub, providing comprehensive oversight of the performance and status of the training rounds 120-1, 120-2, 120-3 during the indirect fire missions.

A connectivity between the round sensors 130-1, 130-2, 130-3, troop equipment 140-1, 140-2, and the command center 150 is facilitated through wireless communication protocols, ensuring seamless transmission of data in real-time. The round sensors 130-1, 130-2, 130-3 collect and transmit information related to projectile movement, positioning within the firing instrument 110, type of round, fuse settings, and other relevant parameters.

In some embodiments, the round sensors 130-1, 130-2, and 130-3 communicate with the troop equipment 140-1, 140-2, and the command center 150 via a communication network that refers to a short-range communication network, for example, a Bluetooth™ communication network. In some embodiments, a specific distance of a preset communication distance may be set according to actual requirements, and the embodiments of the present application are not limited thereto. For example, in the case where the preset communication distance is 10 meters, the wireless communication network may be a Bluetooth™ communication network.

In some embodiments, the communication network may refer to a long-range network that uses wireless data connections for connecting network nodes, for example, Wi-Fi access points, and enabling telecommunications between network nodes. The cellular wireless communication network implements, for example, a long-term evolution (LTE) technology or 5G or satellite.

The above-described setup enables a synchronized and comprehensive training experience, empowering troops with real-time feedback on round behavior and performance during simulated indirect fire missions. The wireless connectivity and data transmission between the round sensors 130-1, 130-2, and 130-3 communicate with the troop equipment 140-1, 140-2, and the command center 150, ensuing seamless information flow, enhancing training effectiveness and operational readiness for military personnel.

Figure 2A:
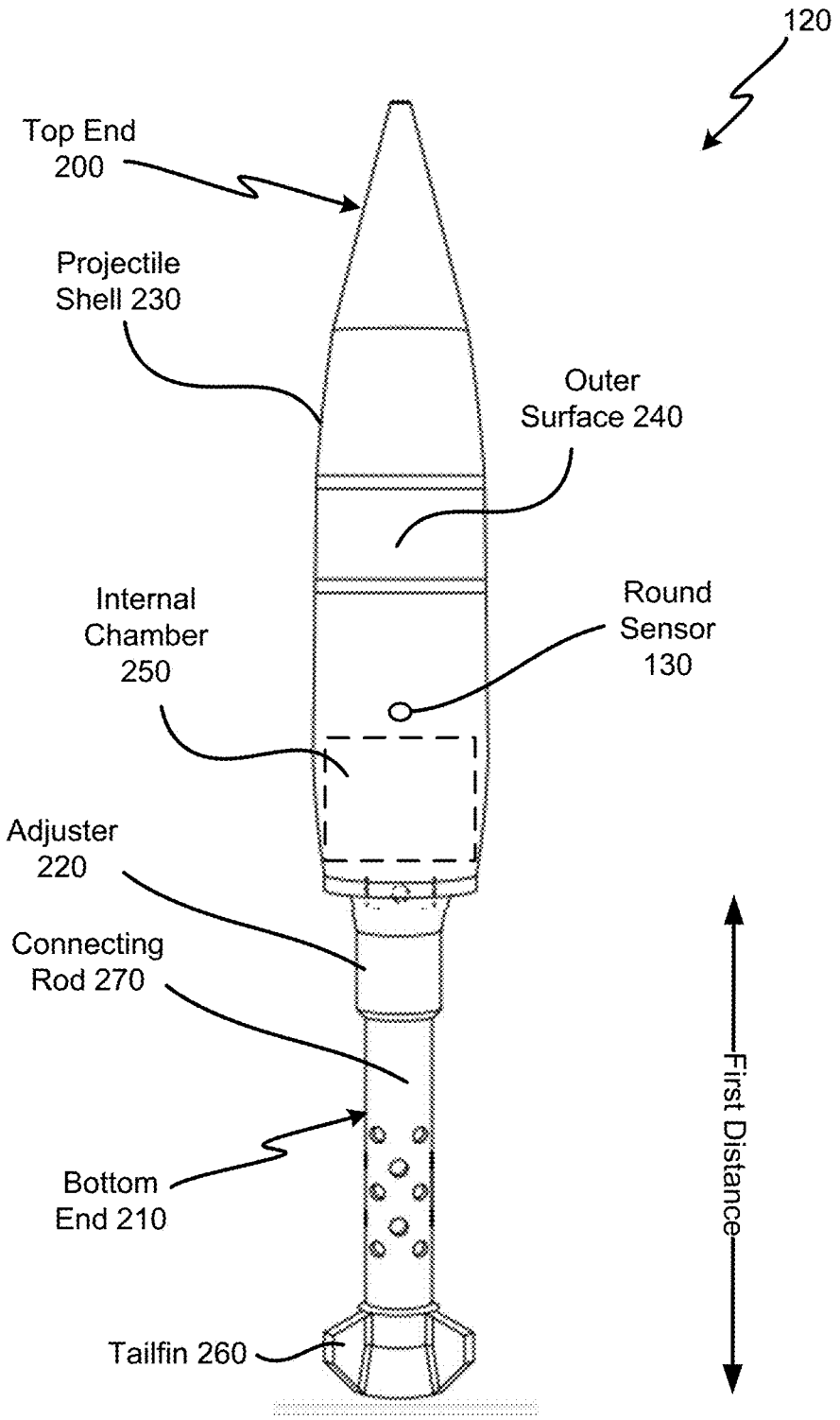
FIG. 2A and FIG. 2B illustrate front-perspective views of a training round according to an embodiment of the present disclosure.
Figure 2B:
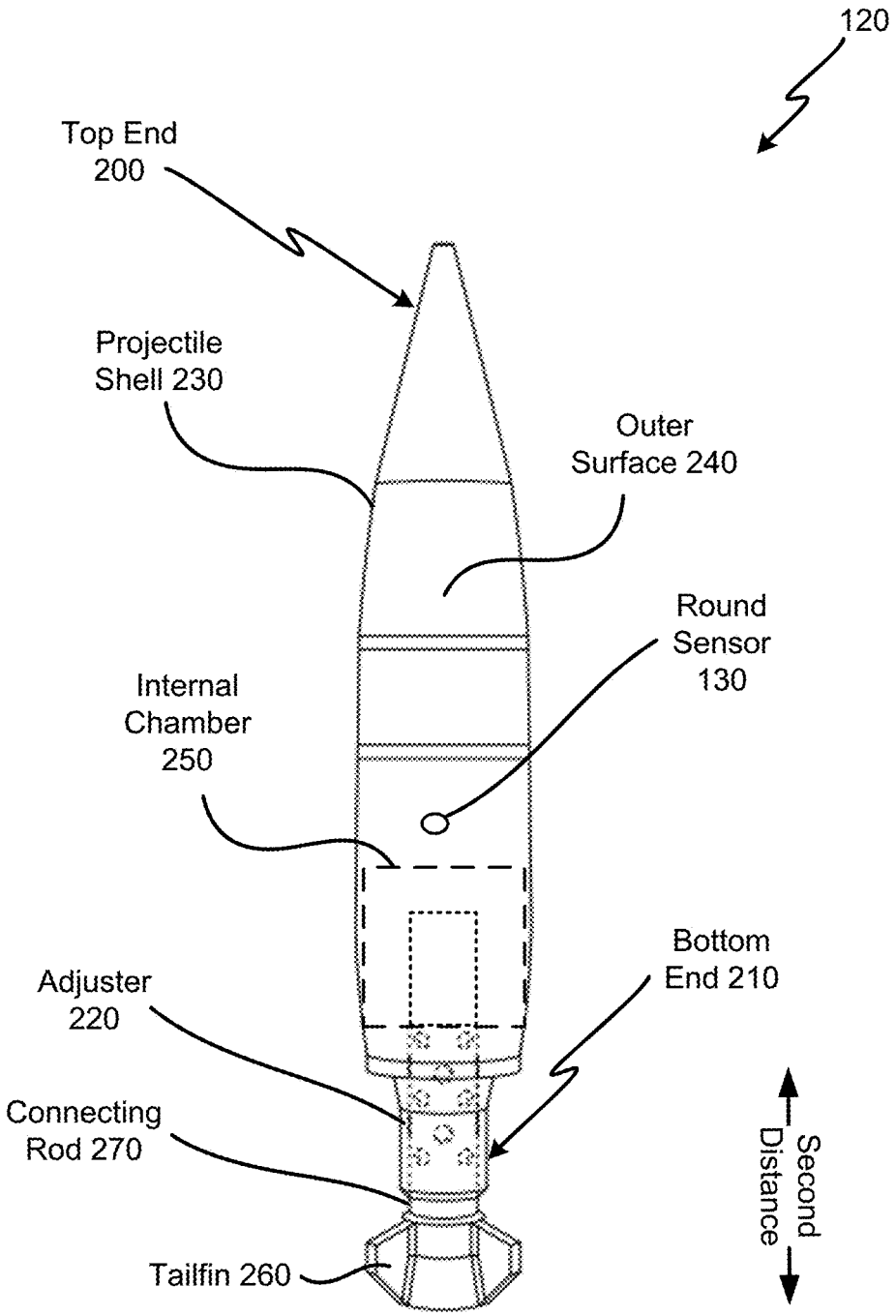

Referring to FIG. 2A and FIG. 2B, illustrate front-perspective views of a training round 120. The training round 120 is a specialized ammunition designed for training purposes, featuring various elements contributing to its adaptability and functionality. For example, the training round 120 is a simulation round designed to function like a mortar bomb. The training round 120 includes a top end 200, a bottom end 210, an adjuster 220, and a round sensor 130.

The top end 200 is oriented towards a direction of projectile motion of the training round 120. The top end 200 is defined by a projectile shell 230. The projectile shell 230 has an outer surface 240 and an internal chamber 250. The internal chamber 250 is depicted by dashed lines. The bottom end 210 defines a tailfin 260 that is movably connected to the projectile shell 230 via a connecting rod 270 (interchangeably referred to as stabilizing rod). The top end 200 and the bottom end 210 are separated by a first distance. In some embodiments, the projectile shell 230 has a conical top oriented towards the direction of projectile motion of the training round 120. The projectile shell 230 further includes an internal chamber having an orifice facing the bottom end.

In some embodiments, the outer surface 240 of the projectile shell 230 has a diameter in a range from 30 millimeters (mm) to 150 mm. In some embodiments, the outer surface 240 of the projectile shell 230 has a diameter in a range from 40 mm to 140 mm. In some embodiments, the outer surface 240 of the projectile shell 230 has a diameter in a range from 50 mm to 130 mm. In some embodiments, the outer surface 240 of the projectile shell 230 has a diameter in a range from 60 mm to 120 mm. In some embodiments, the outer surface 240 of the projectile shell 230 has a diameter in a range from 70 millimeters (mm) to 110 mm. In some embodiments, the outer surface 240 of the projectile shell 230 has a diameter in a range from 80 mm to 100 mm. In some embodiments, the outer surface 240 of the projectile shell 230 has a diameter of 90 mm.

The adjuster 220 is situated between the top end 200 and the bottom end 210 to adjust a length of the training round 120. The adjuster 220 compresses such that the top end 200 and the bottom end 210 are separated by a second distance, and the second distance is less than the first distance as shown in FIG. 2B. A compression action by the adjuster 220 modifies the overall length of the training round 120 because of which a portion of the connecting rod 270 moves inside the internal chamber 250 of the top end 200. The portion of the connecting rod 270 inside the internal chamber 250 is depicted by dotted lines in FIG. 2B. The round sensor 130 is attached to the training round 120. The round sensor 130 communicatively couples to a simulation computer while performing the indirect fire mission. In some cases, the simulation computer is the troop equipment 140 or a remote display 160 at the command center 150. In some embodiments, the round sensor 130 includes an array of sensors configured to transmit data associated with, projectile movement of the training round 120, alignment and positioning of the training round 120 inside the firing instrument 110. For example, the round sensor 130 may monitor and transmit data concerning an alignment and positioning of the training round 120 inside the firing instrument 110. The data may include information about orientation, placement, and adjustments of the training round 120 within the barrel 300 ensuring accurate alignment and readiness for firing. The data may also be associated with the type of the training round. For example, the round sensor 130 may capture and communicate specific data associated with the type of training round being utilized. The data may include details about the model, specifications, payload, and any specialized features of the training round 120. The round sensor 130 may also gather and transmit data regarding a fuse setting of the training round 120. The data may include details about a timing or triggering mechanism set for the training round 120, crucial for simulating a desired detonation or impact scenarios during training exercises.

Figure 3A:
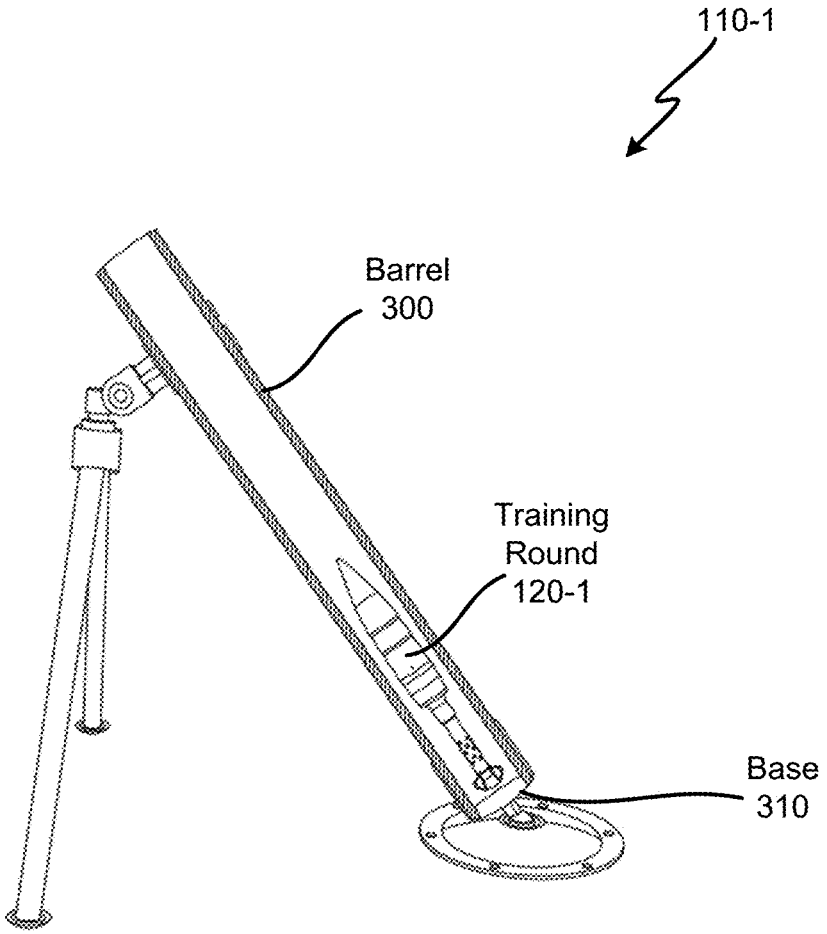
FIG. 3A to FIG. 3C illustrate sectional views of the firing instrument according to an embodiment of the present disclosure.
Figure 3B:
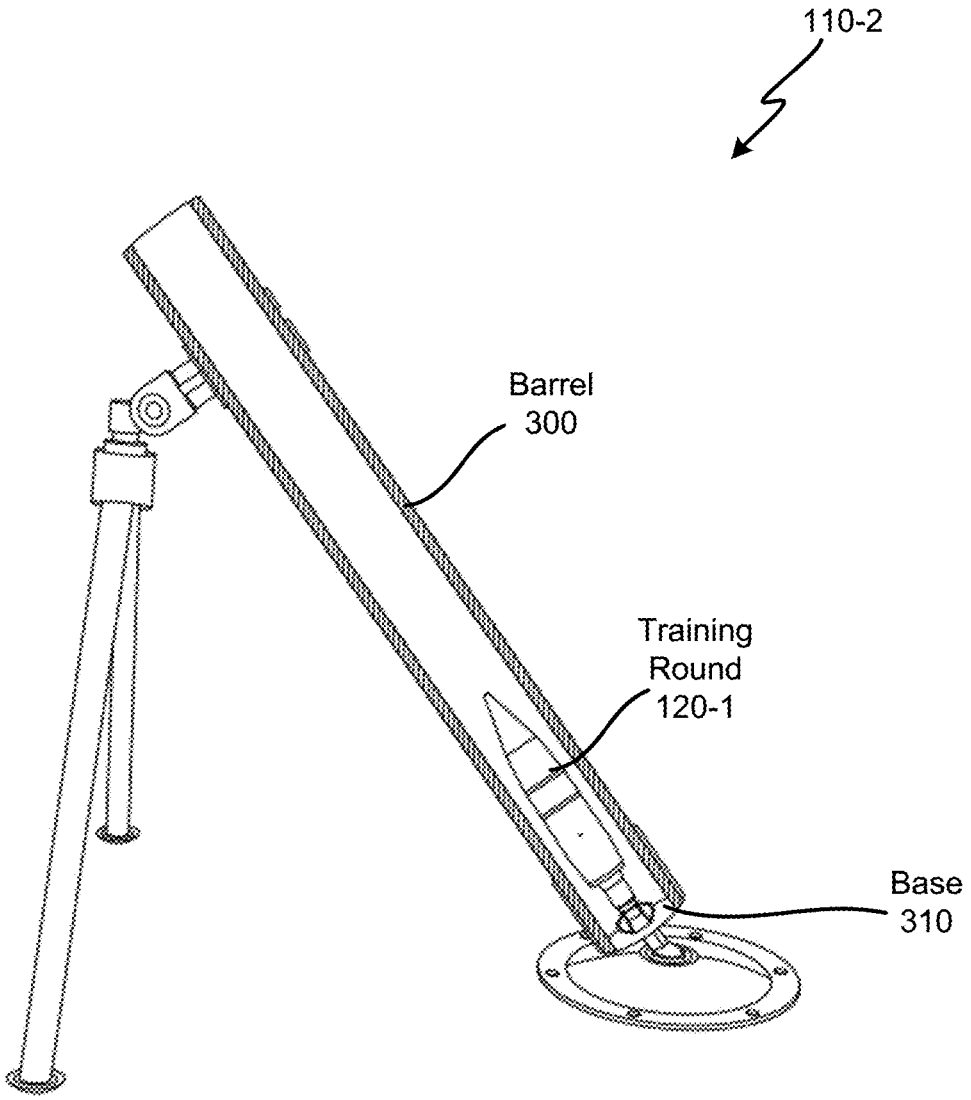
Figure 3C:
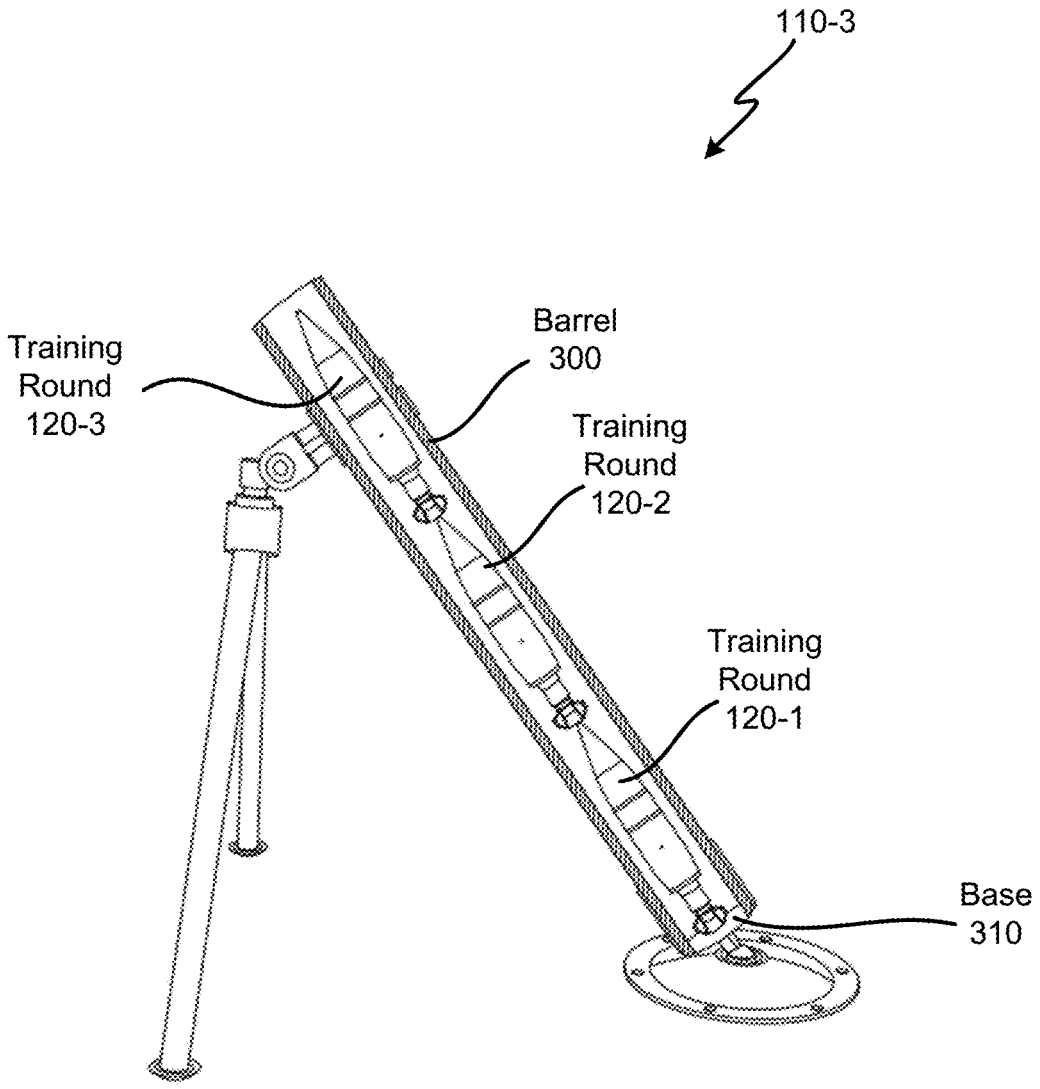

Referring to FIG. 3A to FIG. 3C illustrate sectional views of the firing instrument 110 depicting process by a compression action of the adjuster 220 takes place. Specifically, FIG. 3A illustrates a sectional view of the firing instrument 110-1, providing a detailed depiction of a critical phase before an engagement of the training round 120-1 inside the firing instrument 110-1. The firing instrument 110 is designed for launching the training rounds used in military or law enforcement training exercises, particularly for simulating the indirect fire missions. The firing instrument 110-1 includes a barrel 300 having a base 310. The barrel 300 of the firing instrument 110-1 serves as the launching mechanism for the training round 120-1, providing a structured pathway for a trajectory of the training round 120-1 upon firing. Within the barrel 300, the training round 120-1 is positioned, yet to be fully engaged or activated within the firing instrument 110-1. Notably, the tailfin 260 of the training round 120-1 has not made contact with the base 310 of the barrel 300 at this stage.

The precise positioning of the training round 120-1 in this phase indicates a pre-firing state, where the adjuster 220 is yet to undergo compression. As a result, neither the top end 200 nor the bottom end 210 of the training round 120-1 has been engaged inside the firing instrument 110-1. The adjuster 220 maintains a specific separation between the top end 200 and the bottom end 210 of the round.

Referring to FIG. 3B illustrates a sectional view of the firing instrument 110-2, providing a detailed depiction of a phase in which the bottom end 210 of training round 120-1 engages inside the firing instrument 110-2. As depicted, the engagement of the bottom end 210 of the training round 120-1 occurs when the tailfin 260 of the training round 120-1 makes contact with the base 310 of the barrel 300. This contact signifies the compression of the adjuster 220. The compression occurs precisely upon the engagement of the bottom end 210 inside the firing instrument 110-2, allowing for a telescopic movement between the top end and the bottom end of the training round 120-1.

This compression is triggered by the tailfin 260 contacting the base 310, causing the adjuster 220 to compress and reduce a separation distance between the top end 200 and the bottom end 210 of the training round 120-1. In essence, the compression of the adjuster 220 induces a telescopic movement between the top end 200 and the bottom end 210 of the training round 120-1. The telescopic movement refers to a controlled reduction in a length of the training round 120-1, facilitated by the compressive action of the adjuster 220.

A combination involving a weight of the projectile shell 230 and a force of gravity contributes significantly to the compression action observed upon the engagement of the bottom end. As the tailfin 260 makes contact with the base 310 due to gravitational forces acting on the top end 200 of the training round 120-1 and the weight of the projectile shell, the adjuster 220 compresses. In other words, the gravitational pull, combined with a mass of the projectile shell 230, exerts pressure on the adjuster 220, causing it to compress gradually.

The compression of the adjuster 220 is a result of a downward force exerted by the weight of the projectile shell 230. In some embodiments, the weight of the projectile shell 230 is in a range from 8 kilograms (kg) to 16 kg. In some embodiments, the weight of the projectile shell 230 is in a range from 9 kg to 15 kg. In some embodiments, the weight of the projectile shell 230 is in a range from 10 kg to 14 kg. In some embodiments, the weight of the projectile shell 230 is in a range from 11 kg to 13 kg. In some embodiments, the weight of the projectile shell 230 is 13 kg.

Referring to FIG. 3C illustrates a sectional view of the firing instrument 110-3 with three training rounds 120-1, 120-2, and 120-3 positioned and compressed within the barrel 300 of the firing instrument 110-3. In some embodiments, more than three rounds can be positioned inside the barrel 300 depending upon a nature and size of the training round or different application attributes. The training rounds 120-1, 120-2, and 120-3 are stacked one above the other within the barrel 300. This arrangement is achieved through the compression action facilitated by the adjusters within each of the training rounds 120-1, 120-2, and 120-3. Notably, the compression of training rounds 120-1, 120-2, and 120-3 reduces each their lengths, allowing them to be stacked more compactly in the barrel 300.

In this phase, the tailfin of the first round, 120-1 makes contact with the base 310 of the barrel 300, firmly establishing its position and initiating a compression sequence. Likewise, the tailfin of the second round, 120-2, makes contact with the top end of the first round, while the tailfin of the third round, 120-3, contacts the top end of the second round, forming a vertically stacked configuration. In other words, a barrel 300 can be filled with only one training round, which does not have a feature of length adjustment. However, with the feature of length adjustment more than one training round can be stacked one over the other inside the barrel. The compressed configuration allows for multiple rounds to be positioned within the barrel simultaneously. This setup facilitates consecutive firing simulations without the need to empty the barrel after each round is fired during a simulation. Consequently, troops can conduct continuous training exercises, enhancing proficiency and readiness.

In some embodiments, the adjuster 220 includes a spring arrangement to control a movement between the top end 200 and the bottom end 210. For example, the spring arrangement may function as a shock absorber to minimize sudden movements during compression and expansion, ensuring smoother and controlled movement between the top end and the bottom end. Moreover, when the adjuster 220 disengages or decompresses, the spring mechanism may de-actuate the adjuster 220 to bring back the adjuster to a pre-compression state.

Figure 4A:
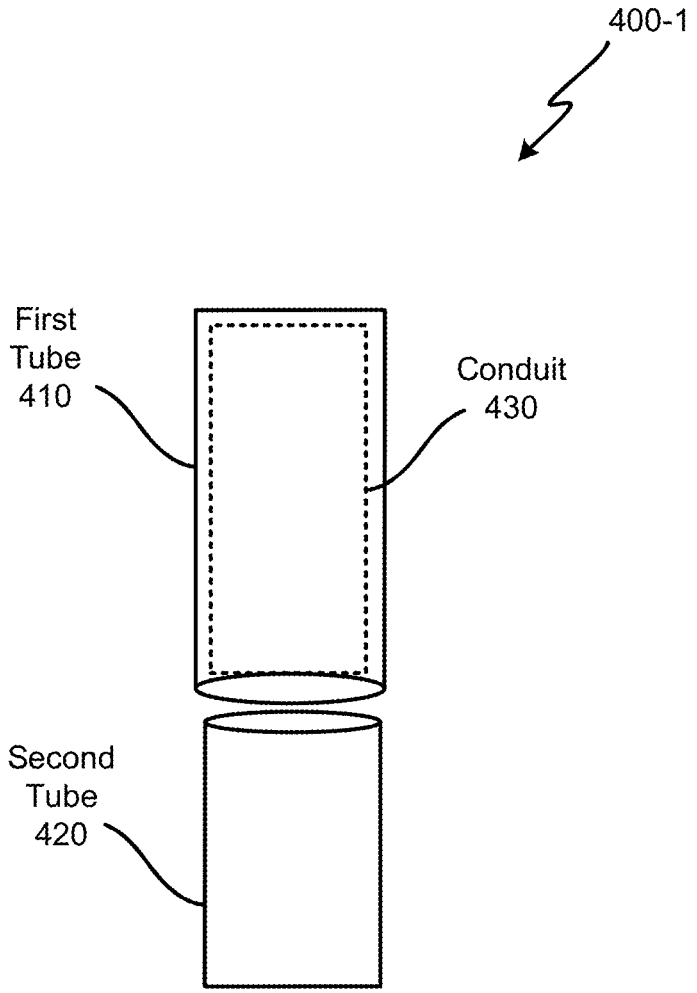
FIGS. 4A and 4B illustrate schematic views of a hydraulic system of the adjuster according to an embodiment of the present disclosure.

Referring to FIG. 4A illustrates a schematic view of a hydraulic system 400-1 of the adjuster 220. The hydraulic system 400 includes a first tube 410, a second tube 420, and a conduit 430 for transmitting fluid between the first tube and the second tube. The hydraulic system 400-1 is depicted in a non-compressed state, illustrating the condition where the first tube does not align or match with the second tube.

Specifically, the first tube 410 is associated with the top end 200 of the training round 120, while the second tube 420 is linked to the bottom end 210. This arrangement signifies the initial phase where the adjuster 220 remains uncompressed, allowing the tubes to exist independently without telescopic movement or alignment.

The non-compressed state of the hydraulic system 400-1 denotes that the second tube 420 is not moved or inserted inside the first tube 410. As a result, there is no induced telescopic movement between the first tube 410 and the second tube 420.

In some embodiments, the adjuster 220 includes a locking mechanism to secure a length adjustment of the training round when fielded. For example, the locking mechanism could be a latch, pin, or a clamping system designed to secure adjusted positions of the second tube with respect to the first tube or with other components within the adjuster 220.

In some embodiments, the adjuster 220 includes 200 a mechanism to adjust the length of the training round variably and in accordance with simulation parameters. The mechanism allows for dynamic and variable adjustments to the length of the training round and enables operators to modify the size of the training round 120, extending or retracting it as necessary during training simulations.

Figure 4B:
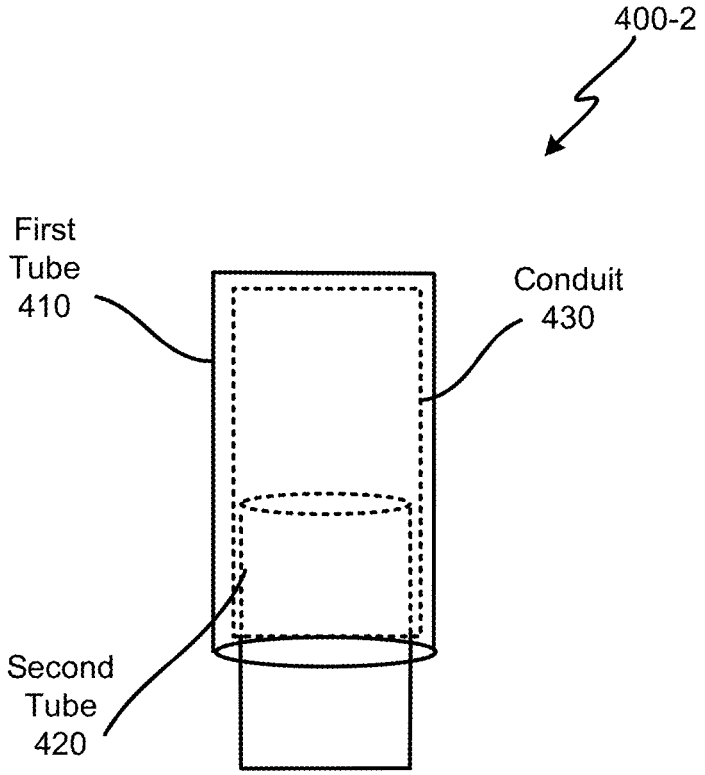

Referring to FIG. 4B illustrates a schematic view of a hydraulic system 400-2 of the adjuster 220. Upon engagement of the training round inside the barrel 300, a downward force is acts upon the top end 200 of the training round. This force is primarily attributed to the weight of the projectile shell 230, which, when inserted into the firing instrument 110, exerts a gravitational force downwards. As a consequence of the downward force applied to the top end, a portion of the second tube 420 starts moving or compressing inside the first tube 410. This movement occurs due to the design of the adjuster 220.

The hydraulic system 400-2 responds to external forces by inducing the telescopic movement between the first tube 410 and the second tube 420. The telescopic movement alters an overall length of the training round, adjusting the training round to a shorter configuration due to the compression. In some embodiments, the hydraulic system 400-2 includes a regulator to control the transmission of the fluid for selective adjustment of the length of the training round.

Figure 5A:
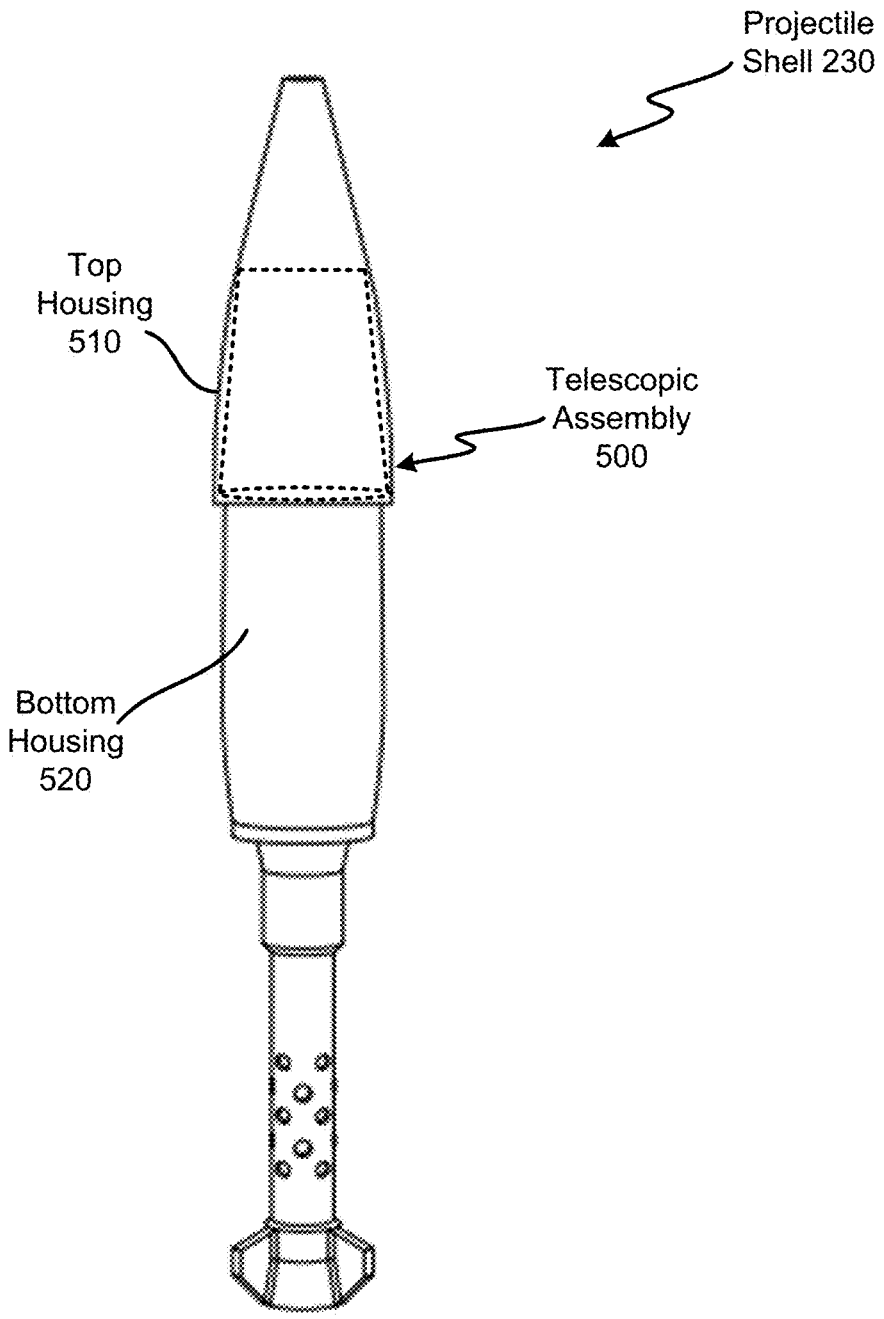
FIG. 5A and FIG. 5B illustrate a schematic views of the training round according to another embodiment of the present disclosure.
Figure 5B:
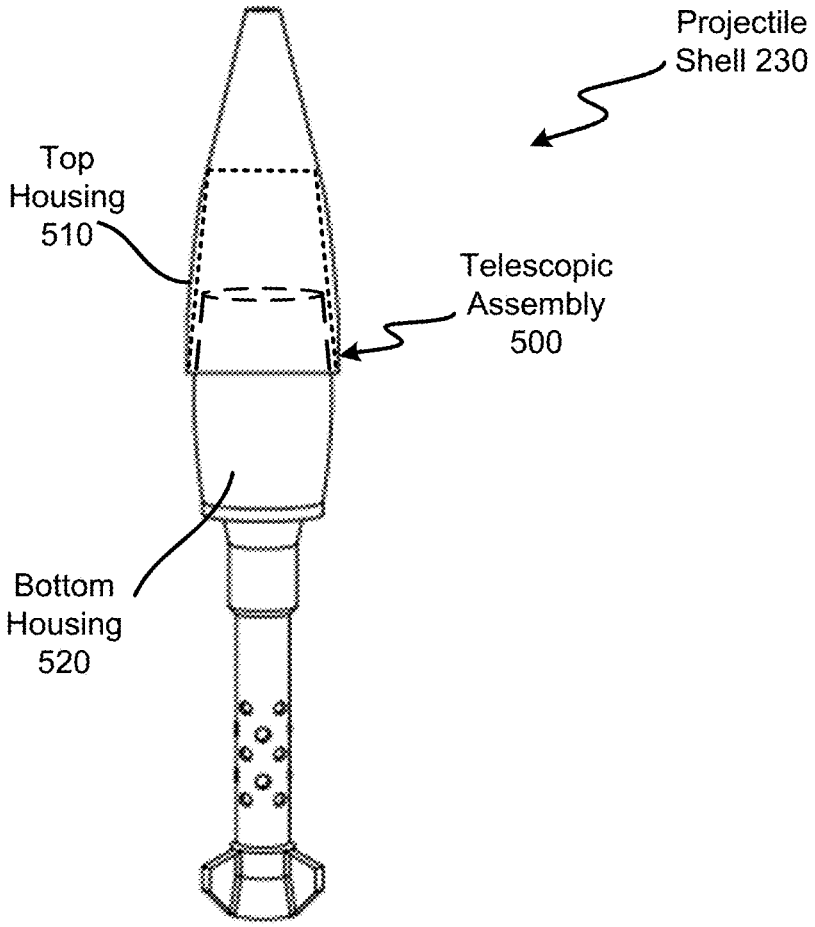

Referring to FIG. 5A and FIG. 5B, illustrate the training round, particularly highlighting a composition of the projectile shell 230. The projectile shell 230 includes a top housing 510 and a bottom housing 520. The top housing 510 is designed as a hollow structure with a specific space reserved inside to accommodate a portion of the bottom housing 520. This accommodation and occurs due to the presence of a telescopic assembly 500, which represents a combination formed by a section of the bottom housing 520 and the internal space within the top housing 510.

The design of the top housing 510, serves as a housing unit capable of receiving and enclosing a segment of the bottom housing 520. This integration is made possible through the telescopic assembly 500, representing the collective arrangement formed by a section of the bottom housing 520 telescoping into the space provided within the top housing 510.

Upon engagement of the training round inside the barrel 300, a downward force acts upon the top housing 510 of the training round. The force is primarily attributed to the weight of the top housing 510 of the projectile shell 230, which, when inserted into the firing instrument 110, exerts a gravitational force downwards. As a consequence, a portion of the bottom housing 520 smoothly slides or fits into the hollow space of the top housing 510, forming a telescopic configuration as shown in FIG. 5B. In some embodiments, the training round comprises a stabilizing rod movably connected to the projectile shell via the telescopic assembly 500, where the projectile shell and the stabilizing rod are separated by a first distance. In some embodiments, the telescopic assembly 500 is situated between the top end and the bottom end to induce a telescopic movement between the top end and the bottom end, such that the top end and the bottom end are separated by a second distance that is shorter as compared to the first distance. The first distance is the distance by which the top end and the bottom end were separated before the telescopic movement. In some embodiments, the weight of the top end induces the telescopic movement between the top end and the bottom end. In some embodiments, the telescopic movement is induced between the top end and the bottom end upon engagement of the stabilizing rod inside the firing instrument, such that the stabilizing rod moves inside the internal chamber through the orifice at the base of the projectile shell.

In some embodiments, the telescopic assembly 500 includes a combination of a pneumatic system and multiple mechanical linkages. The pneumatic system may include components such as air chambers, valves, and pneumatic actuators, while the mechanical linkages include gears, levers, or cams working in conjunction with the pneumatic system. For example, when the training round is inserted into the firing instrument 110, a pneumatic actuator is triggered, initiating the telescopic movement. The pneumatic system pressurizes, and the stored air pressure forces a piston or rod connected to mechanical linkages to move, initiating the telescopic action. In some embodiments, the telescopic assembly includes a mechanism to control the telescopic movement between the top end and the bottom end for adjusting the length of the training round at a predetermined level.

The telescopic assembly 500 adjusts the overall length or configuration of the training round and also allows controlled adjustments and variations in the length of the training round.

Specific details are given in the above description to provide a thorough understanding of the embodiments. However, it is understood that the embodiments may be practiced without these specific details. For example, circuits may be shown in block diagrams in order not to obscure the embodiments in unnecessary detail. In other instances, well-known circuits, processes, algorithms, structures, and techniques may be shown without unnecessary detail in order to avoid obscuring the embodiments.

Implementation of the techniques, blocks, steps and means described above may be done in various ways. For example, these techniques, blocks, steps and means may be implemented in hardware, software, or a combination thereof. For a hardware implementation, the processing units may be implemented within one or more application specific integrated circuits (ASICs), digital signal processors (DSPs), digital signal processing devices (DSPDs), programmable logic devices (PLDs), field programmable gate arrays (FPGAs), processors, controllers, micro-controllers, microprocessors, other electronic units designed to perform the functions described above, and/or a combination thereof.

Also, it is noted that the embodiments may be described as a process which is depicted as a flowchart, a flow diagram, a swim diagram, a data flow diagram, a structure diagram, or a block diagram. Although a depiction may describe the operations as a sequential process, many of the operations can be performed in parallel or concurrently. In addition, the order of the operations may be re-arranged. A process is terminated when its operations are completed, but could have additional steps not included in the figure. A process may correspond to a method, a function, a procedure, a subroutine, a subprogram, etc. When a process corresponds to a function, its termination corresponds to a return of the function to the calling function or the main function.

Furthermore, embodiments may be implemented by hardware, software, scripting languages, firmware, middleware, microcode, hardware description languages, and/or any combination thereof. When implemented in software, firmware, middleware, scripting language, and/or microcode, the program code or code segments to perform the necessary tasks may be stored in a machine readable medium such as a storage medium. A code segment or machine-executable instruction may represent a procedure, a function, a subprogram, a program, a routine, a subroutine, a module, a software package, a script, a class, or any combination of instructions, data structures, and/or program statements. A code segment may be coupled to another code segment or a hardware circuit by passing and/or receiving information, data, arguments, parameters, and/or memory contents. Information, arguments, parameters, data, etc. may be passed, forwarded, or transmitted via any suitable means including memory sharing, message passing, token passing, network transmission, etc.

For a firmware and/or software implementation, the methodologies may be implemented with modules (e.g., procedures, functions, and so on) that perform the functions described herein. Any machine-readable medium tangibly embodying instructions may be used in implementing the methodologies described herein. For example, software codes may be stored in a memory. Memory may be implemented within the processor or external to the processor. As used herein the term "memory" refers to any type of long term, short term, volatile, nonvolatile, or other storage medium and is not to be limited to any particular type of memory or number of memories, or type of media upon which memory is stored.

Moreover, as disclosed herein, the term "storage medium" may represent one or more memories for storing data, including read only memory (ROM), random access memory (RAM), magnetic RAM, core memory, magnetic disk storage mediums, optical storage mediums, flash memory devices and/or other machine readable mediums for storing information. The term "machine-readable medium" includes, but is not limited to portable or fixed storage devices, optical storage devices, and/or various other storage mediums capable of storing that contain or carry instruction(s) and/or data.

While the principles of the disclosure have been described above in connection with specific apparatuses and methods, it is to be clearly understood that this description is made only by way of example and not as limitation on the scope of the disclosure.

We claim:

1. A training round for performing indirect fire mission, the training round comprising:

a top end oriented towards a direction of projectile motion of the training round;

a bottom end situated opposite to the top end, wherein the top end and the bottom end are separated by a first distance;

an adjuster between the top end and the bottom end to adjust a length of the training round, wherein:

the adjuster compresses upon engagement of at least one of the top end and the bottom end inside a firing instrument, such that the top end and the bottom end are separated by a second distance, and the second distance is less than the first distance; and a round sensor attached to the training round, wherein the round sensor communicatively couples to a simulation computer while performing the indirect fire mission.

2. The training round for performing indirect fire mission as claimed in claim 1, wherein the top end is defined by a projectile shell having:

an outer surface, and an internal chamber, wherein the bottom end defines a tailfin that is movably connected to the projectile shell via a connecting rod.

3. The training round for performing indirect fire mission as claimed in claim 2, wherein the outer surface of the projectile shell has a diameter in a range from 30 millimeters (mm) to 150 mm.

4. The training round for performing indirect fire mission as claimed in claim 2, wherein:

weight of the projectile shell induces a telescopic movement between the top end and the bottom end, and the weight of the projectile shell is in a range from 8 kilograms (kg) to 16 kg.

5. The training round for performing indirect fire mission as claimed in claim 1, wherein the adjuster comprises a hydraulic system having:

a first tube, a second tube, and a conduit for a transmission of a fluid between the first tube and the second tube, wherein a telescopic movement is induced between the first tube and the second tube when the second tube moves inside the first tube.

6. The training round for performing indirect fire mission as claimed in claim 1, wherein the round sensor comprises an array of sensors configured to transmit data associated with:

projectile movement of the training round, alignment and positioning of the training round inside a firing instrument, type of the training round, and fuse setting of the training round.

7. The training round for performing indirect fire mission as claimed in claim 1, wherein the adjuster comprises a spring arrangement to control a movement between the top end and the bottom end.

8. The training round for performing indirect fire mission as claimed in claim 1, wherein the adjuster comprises a locking mechanism to secure a length adjustment of the training round when fielded.

9. The training round for performing indirect fire mission as claimed in claim 1, wherein the adjuster comprises a mechanism to adjust the length of the training round variably and in accordance with simulation parameters.

10. A training round for performing indirect fire missions, the training round comprising:

a top end oriented towards a direction of projectile motion of the training round;

a bottom end situated opposite to the top end, wherein the top end and the bottom end are separated by a first distance;

a telescopic assembly between the top end and the bottom end to induce a telescopic movement between the top end and the bottom end, such that the top end and the bottom end are separated by a second distance, wherein a weight of the top end induces the telescopic movement between the top end and the bottom end; and a round sensor attached to the training round, the round sensor establishing communicative coupling with a simulation computer during an execution of indirect fire missions.

11. The training round for performing indirect fire mission as claimed in claim 10, training round further comprises:

a projectile shell having:

a conical top oriented towards the direction of projectile motion of the training round; and an internal chamber having an orifice facing the bottom end; and a stabilizing rod movably connected to the projectile shell via the telescopic assembly, wherein the telescopic movement is induced between the top end and the bottom end upon engagement of the stabilizing rod inside a firing instrument, such that the stabilizing rod moves inside the internal chamber through the orifice.

12. The training round for performing indirect fire mission as claimed in claim 11, wherein the weight of the projectile shell is in a range from 8 kilograms (kg) to 16 kg.

13. The training round for performing indirect fire mission as claimed in claim 10, wherein the telescopic assembly comprises a combination of a pneumatic system and a plurality of mechanical linkages.

14. The training round for performing indirect fire mission as claimed in claim 10, wherein the telescopic assembly comprises a mechanism to control the telescopic movement between the top end and the bottom end for adjusting a length of the training round at a predetermined level.

15. A training round for performing indirect fire missions, the training round comprising:

a projectile shell having:

a conical top oriented towards a direction of projectile motion of the training round; and an internal chamber having an orifice at a base of the projectile shell;

a stabilizing rod connected to the base of the projectile shell, wherein the projectile shell and the stabilizing rod are separated by a first distance;

a hydraulic system between projectile shell and the stabilizing rod to adjust a length of the training round, the hydraulic system having:

a first tube fixedly connected to the projectile shell, a second tube fixedly connected to stabilizing rod and movably connected to the projectile shell, and a conduit for a transmission of a fluid between the first tube and the second tube, wherein:

a telescopic movement is induced between the first tube and the second tube when the second tube moves inside the first tube, and the projectile shell and the stabilizing rod are separated by a second distance upon induction of the telescopic movement; and a round sensor attached to the training round, the round sensor establishing communicative coupling with a simulation computer during an execution of the indirect fire missions.

16. The training round for performing indirect fire mission as claimed in claim 15, wherein the hydraulic system further comprises a regulator to control the transmission of the fluid for selective adjustment of the length of the training round.

17. The training round for performing indirect fire mission as claimed in claim 15, wherein the telescopic movement is induced between the projectile shell and the stabilizing rod upon engagement of the stabilizing rod inside a firing instrument.

18. The training round for performing indirect fire mission as claimed in claim 15, wherein:

weight of the projectile shell induces the telescopic movement between the projectile shell and the stabilizing rod, and the weight of the projectile shell is in a range from 8 kilograms (kg) to 16 kg.

19. The training round for performing indirect fire mission as claimed in claim 15, wherein projectile shell has a diameter in a range from 30 millimeters (mm) to 150 mm.

* * * * *